US007532827B2

(12) United States Patent
Nakazawa

(10) Patent No.: US 7,532,827 B2
(45) Date of Patent: May 12, 2009

(54) IMAGE-FORMING APPARATUS

(75) Inventor: Yoshio Nakazawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 352 days.

(21) Appl. No.: 11/370,524

(22) Filed: Mar. 7, 2006

(65) Prior Publication Data

US 2006/0222379 A1 Oct. 5, 2006

(30) Foreign Application Priority Data

Mar. 30, 2005 (JP) ..... 2005-100099
Mar. 30, 2005 (JP) ..... 2005-100101

(51) Int. Cl.
*G03G 15/00* (2006.01)

(52) U.S. Cl. ..... 399/12; 399/88; 399/90

(58) Field of Classification Search ..... 399/12, 399/88, 90

See application file for complete search history.

(56) References Cited

U.S. PATENT DOCUMENTS

2006/0099002 A1* 5/2006 Kim ..... 399/69

FOREIGN PATENT DOCUMENTS

JP 2004-045687 2/2004

OTHER PUBLICATIONS

Machine translation of JP 2005-122050 A.*

* cited by examiner

*Primary Examiner*—David M Gray
*Assistant Examiner*—Ruth N Labombard
(74) *Attorney, Agent, or Firm*—Hogan & Hartson LLP

(57) ABSTRACT

An image-forming apparatus for forming an image by heating a medium, the image-forming apparatus includes a connector connectable to a heating unit that heats the medium; a conmmercial power supply that generates power to be supplied to the heating unit; a switch system, provided between the heating unit and the conmmercial power supply, that switches the supply of the power to the heating unit on or off; and a switch control unit that controls the switch system based on the heating unit type.

12 Claims, 12 Drawing Sheets

IMAGE-FORMING APPARATUS

CROSS-REFERENCES TO RELATED APPLICATIONS

The entire disclosure of Japanese Patent Applications Nos. 2005-100099 and 2005-100101, which were filed on Mar. 30, 2005, is expressly incorporated herein by reference.

BACKGROUND

1. Technical Field

The present invention relates to an image-forming apparatus such as a printer, copying machine, or facsimile machine.

2. Related Art

JP-A-2004-45687 discloses an example of a conventional image-forming apparatus. It also discloses a fuser with various configurations, included in an image-forming apparatus, for controlling the apparatus in optimum conditions.

However, the above conventional image-forming apparatus has a problem in that the configuration of its power supply system, which supplies the fuser with power, needs to be changed depending on the type of fuser mounted.

SUMMARY

An advantage of some aspects of the invention is the provision of an image-forming apparatus that can resolve the aforementioned problem.

A first aspect of the invention is an image-forming apparatus for forming an image by heating a medium, the image-forming apparatus including: a connector connectable to a heating unit that heats the medium; a commercial power supply that generates power to be supplied to the heating unit; a switch system, provided between the heating unit and the commercial power supply, that switches the supply of the power to the heating unit on or off; and a switch control unit that controls the switch system based on the heating unit type.

A second aspect of the invention is an image-forming apparatus for forming an image by heating a medium, the image-forming apparatus including: a connector connectable to a heating unit that heats the medium; a commercial power supply that generates power to be supplied to the heating unit; a switch system, provided between the heating unit and the commercial power supply, that switches the supply of the power to the heating unit on or off; and a switch control unit that controls the switch system based on the heating unit type and the switch system type.

DESCRIPTION OF EXEMPLARY EMBODIMENTS

Figure 1:
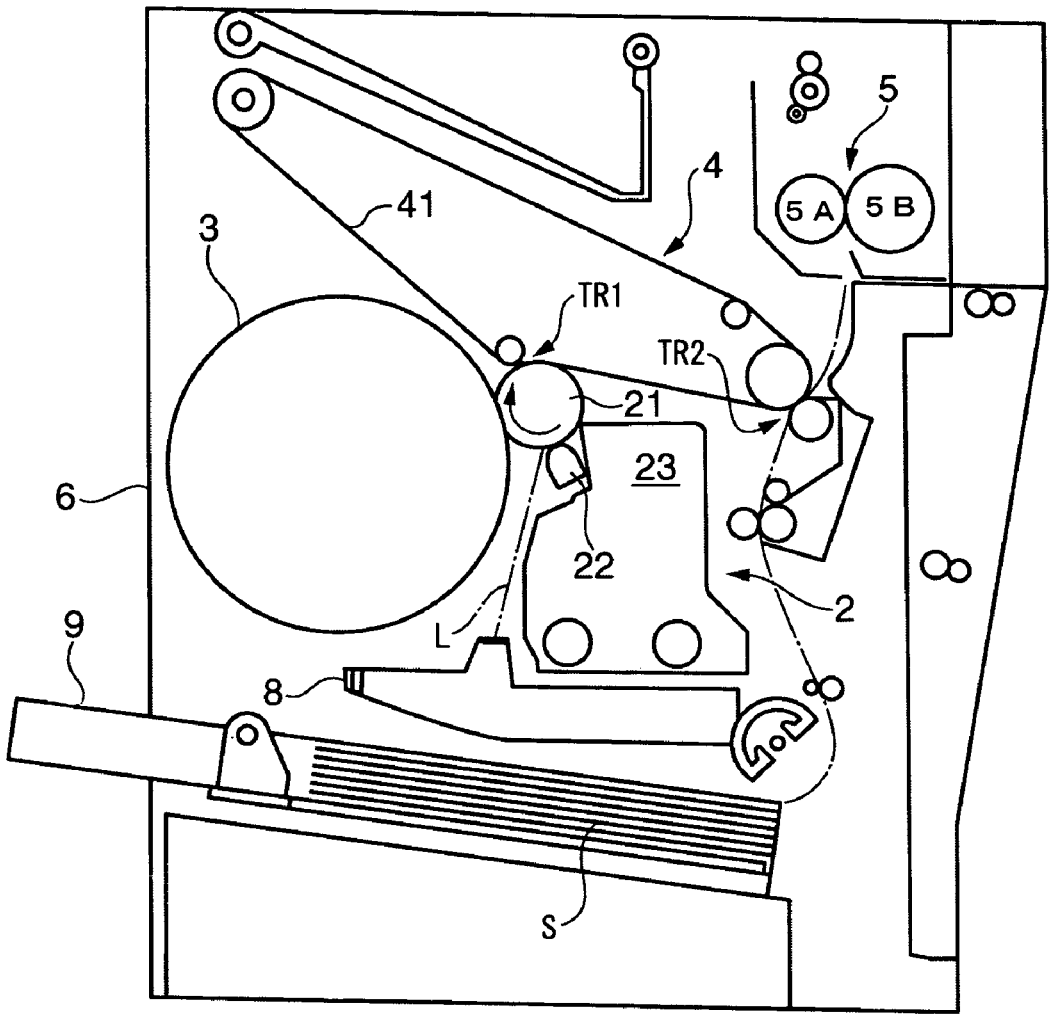
FIG. 1 is a diagram for explaining the entire configuration of an image-forming apparatus according to an embodiment of the invention.

An embodiment of the invention provides an image-forming apparatus for forming an image by heating a medium, the image-forming apparatus including: a connector connectable to a heating unit that heats the medium; a commercial power supply that generates power to be supplied to the heating unit; a switch system, provided between the heating unit and the commercial power supply, that switches the supply of the power to the heating unit on or off; and a switch control unit that controls the switch system based on the heating unit type.

In the above configuration, the image-forming apparatus controls the power supply to the heating unit according to the type of heating unit mounted. Accordingly, the above configuration makes it possible to provide a highly-versatile image-forming apparatus compatible with many types of heating units.

It is preferable that the image-forming apparatus forms an image by fixing toner to the medium, and that the heating unit is a fusing unit that fixes toner to the medium by heating the medium.

In the image-forming apparatus, it is preferable that the heating unit has a memory unit that stores identification information for identifying the heating unit type, and that the switch control unit controls the switch system based on the identification information read from the heating unit connected to the connector. The memory unit stores information such as the number of heating elements constituting the heating unit, the heating element types (those for heating the central part, or for heating both sides), the connection configuration of the heating elements, and the shipping destination for the fusing unit, etc., as identification information.

In the image-forming apparatus, it is preferable that the commercial power supply has a first terminal and a second terminal that supply the power, and that the switch system includes a first relay provided between the first terminal and the heating unit, and a first triac provided between the second terminal and the heating unit. Furthermore, it is preferable that the switch system includes a second relay provided between the first terminal and the heating unit, in parallel with the first relay, and a second triac provided between the second terminal and the heating unit, in parallel with the first triac.

Another embodiment of the invention provides an image-forming apparatus for forming an image by heating a medium, the image-forming apparatus including: a connector connectable to a heating unit that heats the medium; a commercial power supply that generates power to be supplied to the heating unit; a switch system, provided between the heating unit and the commercial power supply, that switches the supply of the power to the heating unit on or off; and a switch control unit that controls the switch system based on the heating unit type and the switch system type.

In the above configuration, the image-forming apparatus controls the power supply to the heating unit according to the switch system type, and the type of heating unit mounted. Accordingly, the above configuration makes it possible to provide a highly-versatile image-forming apparatus compatible with many types of heating units and switch systems.

In the image-forming apparatus, it is preferable that the image-forming apparatus forms an image by fixing toner to the medium, and that the heating unit is a fusing unit that fixes toner to the medium by heating the medium.

It is preferable that the image-forming apparatus further includes a first memory unit that stores switch identification information for identifying the switch system type, that the heating unit has a second memory unit that stores unit identification information for identifying the heating unit type, and that the switch control unit controls the switch system based on the switch identification information and the unit identification information read from the first memory unit and the second memory unit.

The first memory unit stores information such as the number of switches constituting the switch system, the switch types, the configuration of the connection between each of the switches and the connector, the shipping destination for the image-forming apparatus, etc., as switch identification information. The second memory unit stores information such as the number of heating elements constituting the heating unit, the heating element types (those for heating the central part, or for heating both sides), the connection configuration of the heating elements, and the shipping destination for the fusing unit, etc., as unit identification information.

It is preferable that the image-forming apparatus further includes a third memory unit that stores a plurality of programs for controlling the operation of the image-forming apparatus, and that the switch control unit controls the switch system based on a program, from among the plurality of programs, read from the third memory unit based on the switch identification information and the unit identification information.

The above configuration makes it possible to select a suitable program based on the combination of the heating unit and the switch system, and also to properly control the switch system, providing a further highly-versatile image-forming apparatus.

It is preferable that the image-forming apparatus further includes a fourth memory unit that stores a plurality of combinations of switch identification information and unit identification information, and a notification unit that gives a notification based on the result of comparing the switch identification information and the unit identification information read from the first memory unit and the second memory unit, and the plurality of combinations stored in the fourth memory unit.

The above configuration makes it possible to, for example, notify the user when the combination of the heating unit and the switch system is not compatible.

In the image-forming apparatus, it is preferable that the commercial power supply has a first terminal and a second terminal to supply the power and that the switch system includes a first relay provided between the first terminal and the heating unit, and a first triac provided between the second terminal and the heating unit. Also, it is preferable that the switch system further includes a second relay provided between the first terminal and the heating unit, in parallel with the first relay, and a second triac provided between the second terminal and the heating unit, in parallel with the first triac.

Embodiments of the invention are described below with reference to the drawings. However, the below embodiments do not limit the invention, and all the combinations of the features described in the embodiments are not always necessary to achieve the invention.

FIG. 1 is a diagram for explaining the entire configuration of an image-forming apparatus according to an embodiment of the invention. The image-forming apparatus shown in FIG. 1 is an apparatus that forms full-color images by overlapping four kinds of color toner, yellow (Y), magenta (M), cyan (C), and black (K), or monochrome images using black toner, using the electrophotographic method. This image-forming apparatus, upon receipt from an external apparatus (not shown), such as a host computer, of an image signal, activates its components in response to control by a main controller and an engine controller to form (i.e., print) an image corresponding to the image signal on a sheet S, which is a medium such as copy-paper, transfer-paper, paper, or an OHP transparent sheet, etc.

The image-forming apparatus shown in FIG. 1 is configured so that each of a photo-conductor unit 2, a development unit 3, an intermediate transfer unit 4, and a fusing unit 5, which is an example of a heating unit, can freely be attached to and detached from the apparatus body (chassis 6). The fusing unit 5 has a heating roller 5A and a pressure roller 5B. In the state in which these units are mounted in the apparatus body 6, as shown in FIG. 1, a photo conductor 21 in the photoreceptor unit 2 rotates in the direction of the shown arrow, and a charging unit 22, the rotary development unit 3, and a cleaning unit 23 are respectively arranged around the photo conductor 21. The rotary development unit 3 includes four development units corresponding to the YMCK colors. A charging bias is applied to the charging unit 22, thereby uniformly charge the outer peripheral surface of the photo conductor 21. The cleaning unit 23 scrapes toner remaining on the outer peripheral surface of the photo conductor 21 after execution of the primary transfer, cleaning the photo conductor 21.

An exposure unit 8 outputs laser light L in response to an image signal from the engine controller to expose the outer periphery surface of the photo conductor 21 to the light, thereby forming an electrostatic latent image corresponding to the image signal on the photo conductor 21. The electrostatic latent image formed through the above process is then subject to toner development by the development unit 3. Consequently, the electrostatic latent image on the photoreceptor 21 is expressed by the YMCK toner. The toner image developed as above is primary-transferred onto an intermediate transfer belt 41 of the intermediate transfer unit 4 at a primary-transfer area TR1. The image formed on the intermediate transfer belt 41 is secondary-transferred onto the sheet S that has been pulled out of a cassette 9. The sheet S with the image formed thereon is carried via the fusing unit 5 to a tray provided on the upper surface of the apparatus body 6.

Figure 2:
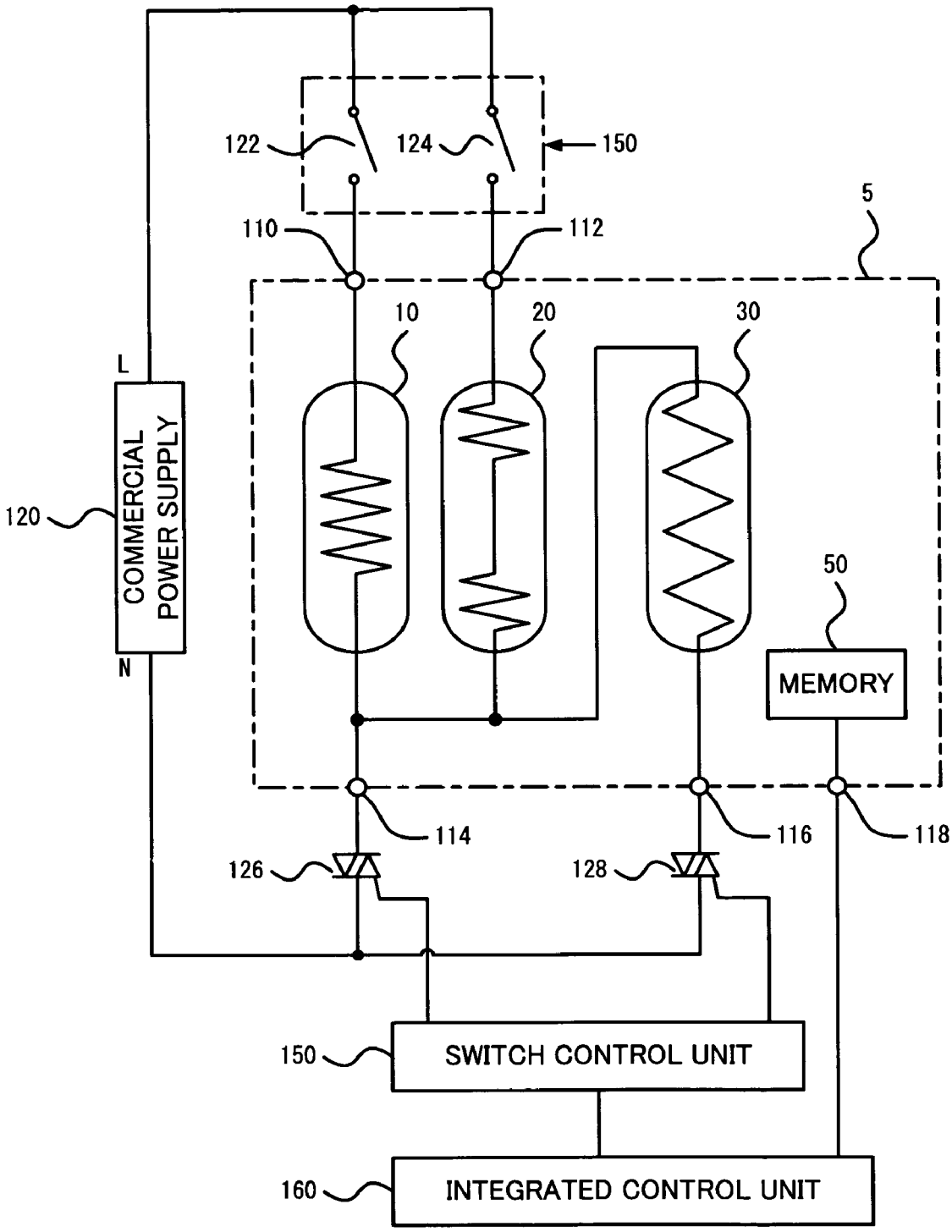
FIG. 2 is a diagram showing the configurations of a fusing unit and a power supply system according to the first embodiment of the invention.

FIG. 2 is a diagram showing the configurations of the fusing unit 5 and the power supply system according the first embodiment of the invention. The power supply system includes terminals 110 to 118, a first relay 122 and a second relay 124, a first triac 126 and a second triac 128, a commercial power supply 120, and a switch control unit 150. The terminals 110 to 118 are examples of connectors connectable to the fusing unit 5. The first relay 122 and the second relay 124, and the first triac 126 and the second triac 128 constitutes an example of a switch system that switches the power supply to the fusing unit 5 on or off.

The fusing unit 5 has a first halogen lamp 10, a second halogen lamp 20, a third halogen lamp 30, which are examples of power loads, and memory 50, which is an example of a memory unit. The memory 50 may be non-volatile memory such as FRAM.

In this embodiment, the first halogen lamp 10 is configured so that it heats the central part of an area where the image-forming apparatus can form images, and the second halogen lamp 20 is configured so that it heats both sides of the area. In other words, the image-forming apparatus, when forming an image on a medium with a large width, such as A4 paper, heats the medium using both the first halogen lamp 10 and the second halogen lamp 20, and when forming an image on a medium with a small width, such as B5 paper, heats the medium using the first halogen lamp 10 only.

The third halogen lamp 30 is connected in series to the first halogen lamp 10 and the second halogen lamp 20, and functions as an auxiliary halogen lamp for suppressing any inrush current that flows into the first halogen lamp 10 and the second halogen lamp 20.

The first halogen lamp 10 and the second halogen lamp 20 are provided inside the heating roller 5A of the fusing unit 5, and the third halogen lamp 30 is provided inside the pressure roller 5B of the fusing unit 5. The third halogen lamp 30 may be provided inside the heating roller 5A together with the first halogen lamp 10 and the second halogen lamp 20 to heat the heating roller 5A.

The memory 50 stores identification information for identifying the type of fusing unit 5. The memory 50 stores information on the halogen lamps provided in the fusing unit 5 as identification information for the fusing unit 5. More specifically, the memory 50 stores information like the number of halogen lamps, the halogen lamp types (those for heating the central part, and for heating both sides, etc.), and the connection configuration of the halogen lamps as identification information. When the configuration of the fusing unit 5 is set according to the destination where the image-forming apparatus is to be shipped, the memory 50 may store the shipping destination as identification information.

The terminals 110 to 118 connect the image-forming apparatus body and the fusing unit 5. The terminals 110 to 118, upon the fusing unit 5 being mounted in the image-forming apparatus body, are connected to the first halogen lamp 10, the second halogen lamp 20, the third halogen lamp 30 and the memory 50, so that the halogen lamps can be supplied with power via the terminals, and identification information can be read from the memory 50.

More specifically, upon the fusing unit 5 being mounted in the image-forming apparatus body, the terminals 110 and 112 are respectively connected to one end of the first halogen lamp 10 and the second halogen lamp 20, and the terminal 114 is connected to the other ends of the first halogen lamp 10 and the second halogen lamp 20. Consequently, it becomes possible to supply the first halogen lamp 10 and the second halogen lamp 20 with power.

The terminal 114 is connected also to one end of the third halogen lamp 30, and the terminal 116 is connected to the other end of the third halogen lamp 30. Consequently, it becomes possible to supply the third halogen lamp 30 with power. Furthermore, the terminal 118 is connected to the memory 50, making it possible to read the identification information for the fusing unit 5 from the memory 50.

The commercial power supply 120 generates power to be supplied to the fusing unit 5. In this embodiment, the commercial power supply 120 supplies the fusing unit 5 with an alternate voltage that has been supplied from a commercial alternate power source to the image-forming apparatus. The commercial power supply 120 has a live-side terminal L, which is an example of a first terminal, and a neutral-side terminal N, which is an example of a second terminal. The live-side terminal L is connected to one end of the first halogen lamp 10 and the second halogen lamp 20, and the neutral-side terminal N is connected to the other ends of those lamps.

The relays 122 and 124, which are provided between the live-side terminal L of the commercial power supply 120, and the fusing unit 5, switch the connection between the commercial power supply 120 and the fusing unit 5 on or off. More specifically, the relay 122, which is provided between the live-side terminal L and the terminal 110, switches the connection between the commercial power supply 120 and the first halogen lamp 10 on or off. The relay 124, which is provided between the live-side terminal L and the terminal 112, switches the connection between the commercial power supply 120 and the second halogen lamp 20 on or off.

The triacs 126 and 128, which are provided between the neutral-side terminal N of the commercial power supply 120, and the fusing unit 5, switch the connection between the commercial power supply 120 and the fusing unit 5 on or off. More specifically, the triac 126, which is provided between the neutral-side terminal N and the terminal 114, switches the connection between the commercial power supply 120, and the first halogen lamp 10, the second halogen lamp 20, and the third halogen lamp 30 on or off. The triac 128, which is provided between the neutral-side terminal N and the terminal 116, switches the connection between the commercial power supply 120 and the third halogen lamp 30 on or off.

The switch control unit 150 controls the relays 122 and 124, and the triacs 126 and 128. More specifically, the switch control unit 150, based on instructions from an integrated control unit 160, switches the relays 122 and 124, and triacs 126 and 128 on or off separately to supply or not supply power to the first halogen lamp 10, the second halogen lamp 20 and the third halogen lamp 30.

In other words, the switch control unit 150 switches on both the relay 122 and the triac 126 to supply the first halogen lamp 10 with power, and switches on both the relay 124 and the triac 126 to supply the second halogen lamp 20 with power. Furthermore, the switch control unit 150 switches on the triac 128 to supply the third halogen lamp 30 with power.

The integrated control unit 160 integrally controls the operation of the image-forming apparatus. In this embodiment, the integrated control unit 160 reads the identification information for the fusing unit 5 from the memory 50, and controls the switch control unit 150 based on that identification information.

More specifically, in this embodiment, the memory 50 stores identification information indicating that the fusing unit 5 has the first halogen lamp 10, the second halogen lamp 20 and the third halogen lamp 30. Based on the identification information read from the memory 50, the integrated control unit 160 determines that the fusing unit 5 has the first halogen lamp 10, the second halogen lamp 20, and the third halogen lamp 30, and controls the switch control unit 150 accordingly.

For example, when forming an image on a medium with a small width, such as B5 paper, the integrated control unit 160 controls the switch control unit 150 to turn the relay 122 and the triac 126 on. Consequently, power is supplied only to the first halogen lamp 10, heating the medium. When forming an image on a medium with a large width, such as A4 paper, the integrated control unit 160 controls the switch control unit 150 to turn the relay 124 and the triac 126 on. Consequently, power is supplied only to the second halogen lamp 20, heating the heating roller 5A to heat the medium. In these cases, it is possible to first turn the relay 122 or 124 and then the triac 126 on.

The integrated control unit 160 controls the switch control unit 150 so that the triac 126 is turned on or off to maintain the heating roller 5A at a predetermined temperature. The image-forming apparatus has a temperature detection unit, e.g., a thermistor, near the fusing unit 5, and the integrated unit 160 controls the switch control unit 150 based on the temperature detected by the temperature detection unit.

When suppressing the inrush current that flows into the first halogen lamp 10 and the second halogen lamp 20, the integrated control unit 160 controls the switch control unit 150 so that the triac 128 is turned on before turning on the relays 122 and 124, and the triac 126. As a result, the first halogen lamp 10 and the second halogen lamp 20 are connected in series to the third halogen lamp 30, making it possible to reduce the inrush current that flows into the fusing unit 5 when the relays 122 and 124, and the triac 126 are turned on, and consequently, to reduce flicker generated by the inrush current that flows into the fusing unit 5.

After the heating roller 5A is preheated by the first halogen lamp 10, the second halogen lamp 20, and the third halogen lamp 30, the integrated control unit 160 controls the switch control unit 150 so that the triac 128 is turned off and the triac 126 is turned on. Consequently, the heating roller 5A is heated by the first halogen lamp 10 and/or the second halogen lamp 20.

When the first halogen lamp 10 and/or the second halogen lamp 20 is turned off and then turned on again to maintain the heating roller 5A at a predetermined temperature, the integrated control unit 160 may turn the triac 126 on to turn the first halogen lamp 10 and/or the second halogen lamp 20 on, and also may turn the triac 128 on and then turn it off, and then turn on the triac 126 to turn on the first halogen lamp 10 and/or the second halogen lamp 20.

The integrated control unit 160, when information regarding the shipping destination for the image-forming apparatus or the fusing unit 5 is stored in the memory 50, may turn the third halogen lamp 30 on or off based on that information. For example, if the shipping destination stored in the memory 50 is a country or area not requiring compliance with flicker standards (e.g., Japan), the integrated control unit 160 does not use the third halogen lamp 30, and if it is a country or area requiring compliance with flicker standards (e.g, Europe), it uses the third halogen lamp 30.

Figure 3:
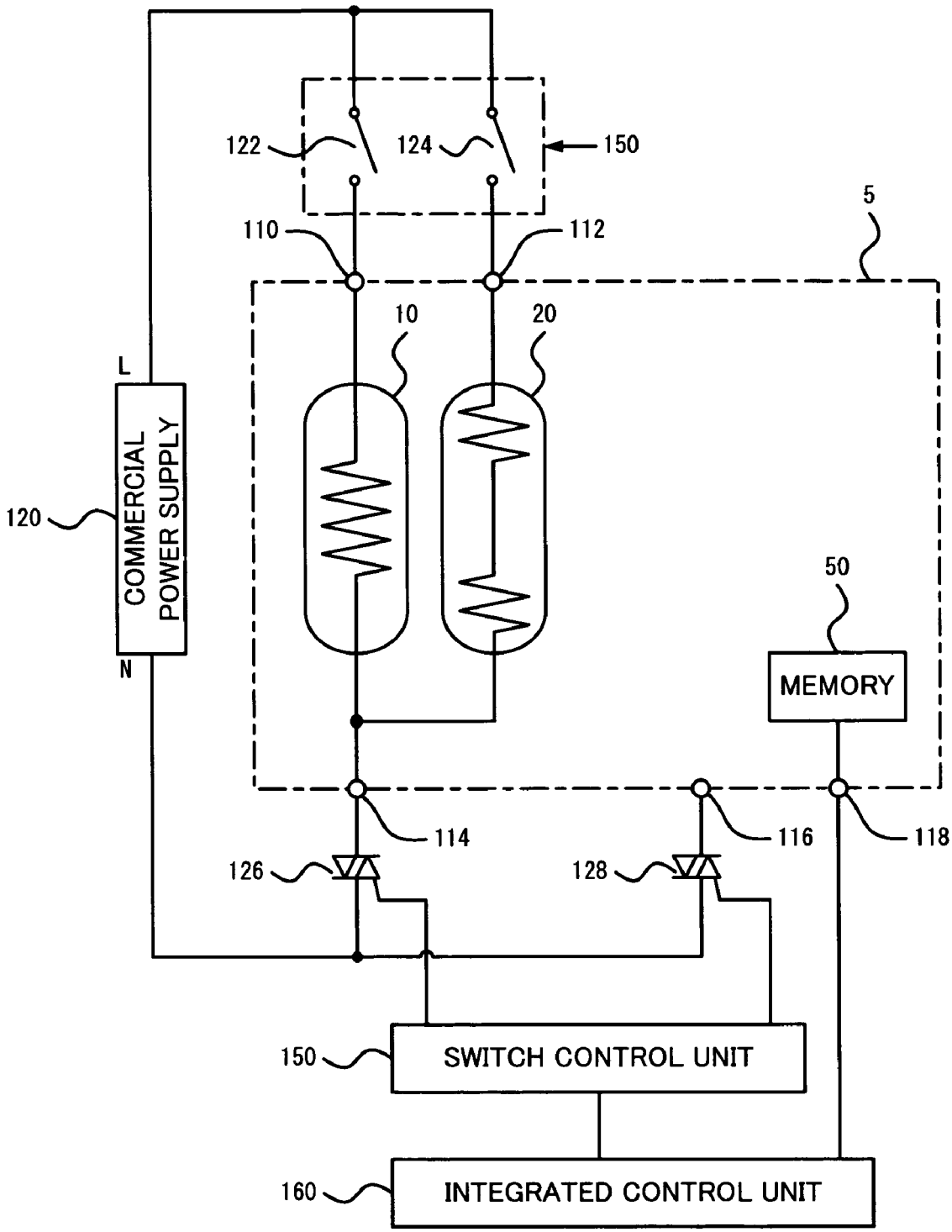
FIG. 3 is a diagram showing the configuration of a fusing unit according to the second embodiment of the invention.

FIG. 3 is a diagram showing the configuration of a fusing unit 5 according to the second embodiment of the invention. The configuration of the fusing unit 5 and the operation of the image-forming apparatus according to the second embodiment will be explained below focussing on the differences between it and the first embodiment. The configurations provided with the same reference numerals as those in the first embodiment have the same configurations and functions as those in the first embodiment.

The fusing unit 5 according to this embodiment has the first halogen lamp 10, the second halogen lamp 20, and the memory 50. In other words, compared to the fusing unit 5 according to the first embodiment (FIG. 2), the fusing unit 5 according to this embodiment has no third halogen lamp 30. The fusing unit 5 according to this embodiment is one that is to be shipped to a country or area not requiring compliance with flicker standards (e.g., Japan).

In this embodiment, the memory 50 stores the information indicating that the fusing unit 5 only has the first halogen lamp 10 and the second halogen lamp 20. The integrated control unit 160 reads the identification information from the memory 50, and uses that to control the switch control unit 150. The integrated control unit 160 controls the switch control unit 150 to arbitrarily turn the relays 122 and 124, and the triac 126 on or off according to the size, etc., of the medium.

Figure 4:
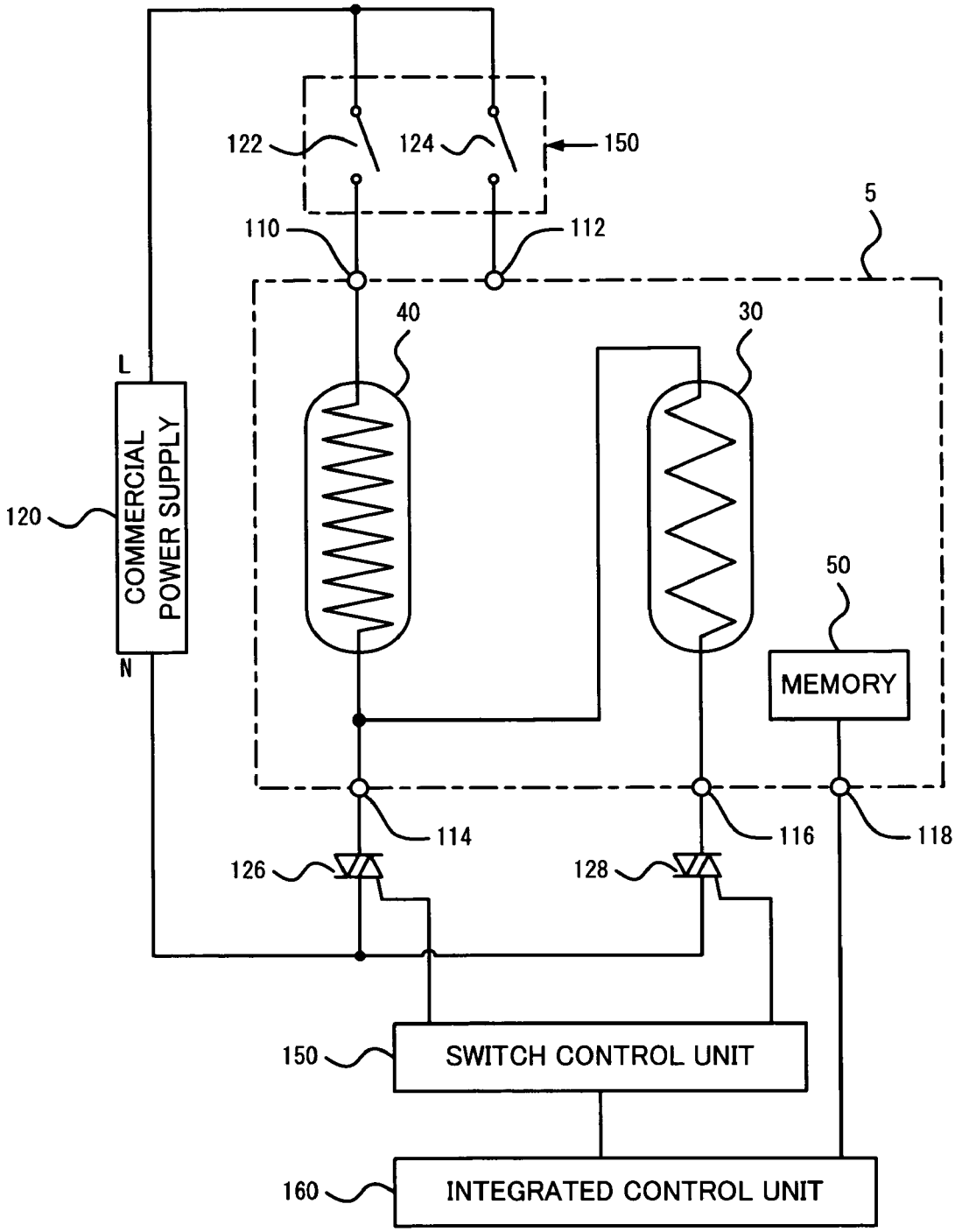
FIG. 4 is a diagram showing the configuration of a fusing unit according to the third embodiment of the invention.

FIG. 4 is a diagram showing the configuration of a fusing unit 5 according to the third embodiment of the invention. The configuration of the fusing unit 5 and the operation of the image-forming apparatus according to the third embodiment will be explained below focussing on the differences between it and the first and second embodiments. The configurations provided with the same reference numerals as those in the first and second embodiments have the same configurations and functions as those in those first and second embodiments.

The fusing unit 5 according to this embodiment has a fourth halogen lamp 40 instead of the first halogen lamp 10 and the second halogen lamp 20 (see FIGS. 1 and 2). The fourth halogen lamp 40 can heat an area that is substantially the same in size as the area of the heating roller 5A that is heated by the first halogen lamp 10 and the second halogen lamp 20. The fourth halogen lamp 40 is provided in the same position as the first halogen lamp 10 in the fusing unit 5. The fusing unit 5 according to this embodiment is one that is to be shipped to a country or area requiring compliance with flicker standards where users do not use mediums with different widths very much (e.g. Europe).

In this embodiment, the memory 50 stores identification information indicating that the fusing unit 5 only has the third halogen lamp 30 and the fourth halogen lamp 40. The integrated control unit 160 reads the identification information from the memory 50, and uses that to control the switch control unit 150. The integrated control unit 160 controls the switch control unit 150 to arbitrarily turn the relay 122, and the triacs 126 and 128 on or off according to whether or not to suppress the inrush current.

Figure 5:
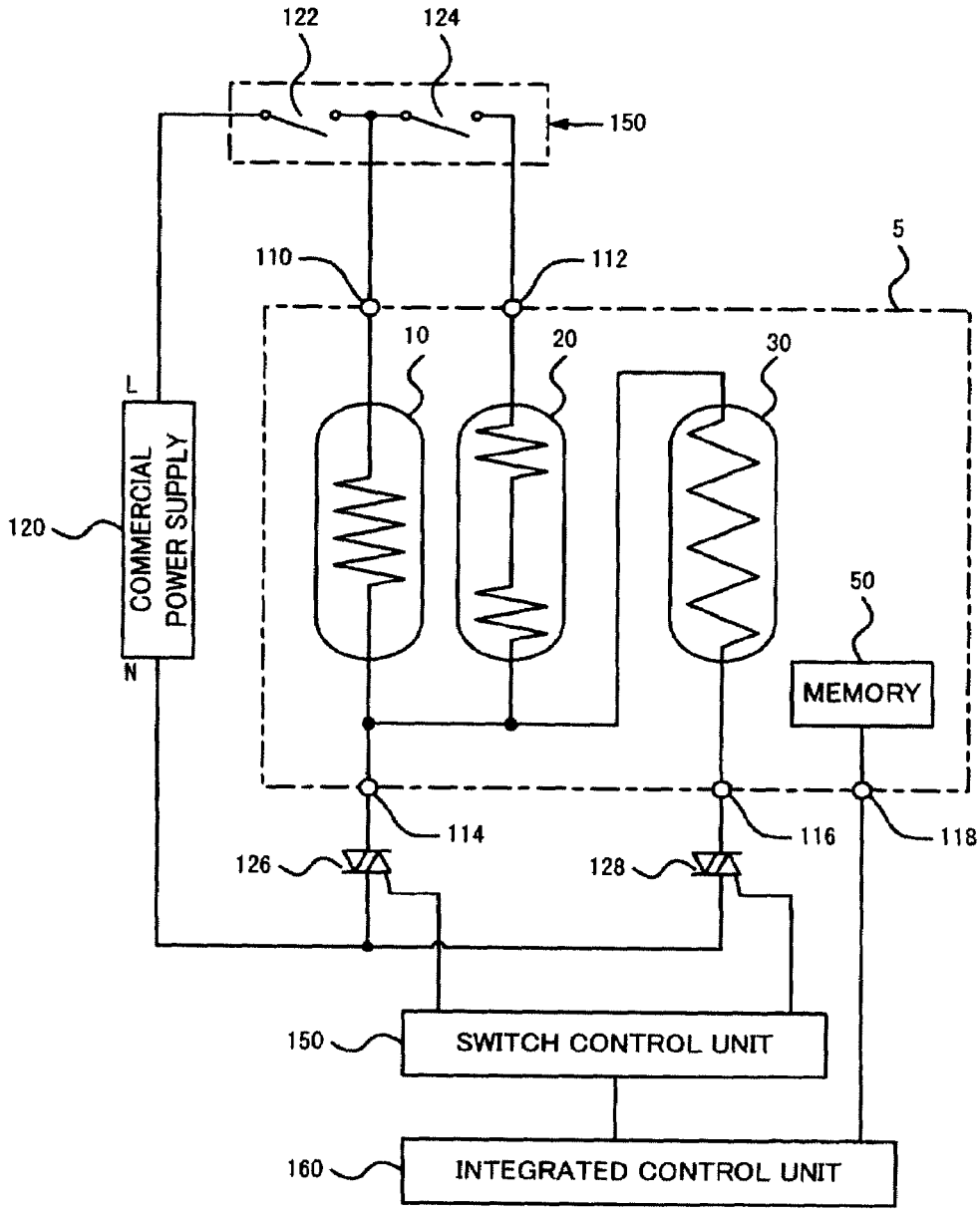
FIG. 5 is a diagram showing another example of a power supply system that supplies power to a fusing unit according to an embodiment of the invention.

FIG. 5 is a diagram showing another example of a power supply system that supplies the fusing unit 5 with power. As shown in FIG. 5, the relays 122 and 124 may be connected in series. In other words, the relay 124 is provided between the relay 122 and the terminal 112, and the terminal 112 is connected to the commercial power supply 120 via the relays 122 and 124. The integrated control unit 160, as in the first to fourth embodiments, heats the heating roller 5A by controlling the switch control unit 150 to turn the relays 122 and 124 on or off.

The above-described embodiments make it possible for the integrated control unit 160 and the switch control unit 150 to control the power supply to the fusing unit 5 according to the type of fusing unit 5 mounted in the image-forming apparatus. Accordingly, the above embodiments make it possible to provide a highly-versatile image-forming apparatus compatible with many types of fusing units 5.

Figure 6:
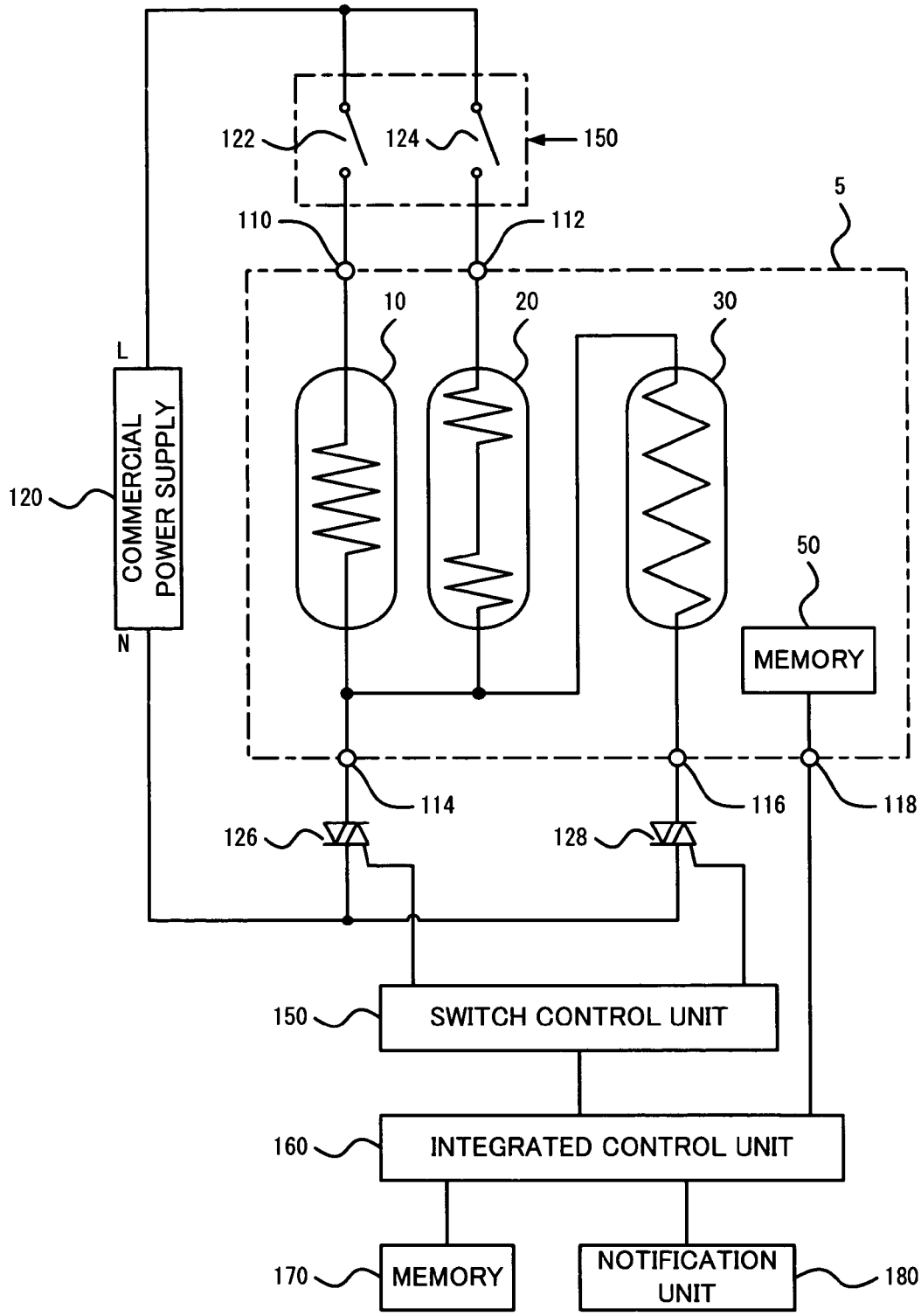
FIG. 6 is a diagram showing the configurations of a fusing unit and a power supply system according to the fourth embodiment of the invention.

FIG. 6 is a diagram showing the configurations of a fusing unit 5 and a power supply system according to the fourth embodiment of the invention. The configuration of the fusing unit 5 and the operation of the power supply system according to the fourth embodiment will be explained below focussing on the differences between it and the above embodiments. The configurations provided with the same reference numerals as those in the above embodiments have the same configurations and functions as those in these embodiments.

The integrated control unit 160 integrally controls the operation of the image-forming apparatus. In this embodiment, the integrated control unit 160 reads unit identification information for the fusing unit 5 from the memory 50, and also reads switch identification information, combination information, and a program from the memory 170, and based on the information and program, controls the switch control unit 150 and the components in the image-forming apparatus.

More specifically, in this embodiment, the memory 50 stores identification information indicating that the fusing unit 5 has the first halogen lamp 10, the second halogen lamp 20 and the third halogen lamp 30. The memory 170 stores switch identification information indicating that the switch system has the relays 122 and 124, and the triacs 126 and 128.

The integrated control unit 160 compares the combination of the unit identification information read from the memory 50 and the switch identification information read from the memory 170, with the combination information stored in the memory 170. If the combination is one contained in the combination information, the integrated control unit 160 determines that that combination is compatible, and then reads a program suitable for that combination from the memory 170, and controls the switch control unit 150 based on the program.

In the embodiment shown in FIG. 6, the combination is one in which the halogen lamps of the fusing unit 5 are properly connected to the terminals 110 to 116, and that is included in the combination information stored in the memory 170. Accordingly, the integrated control unit 160 determines that the combination of the fusing unit 5 and the switch system is compatible.

The integrated unit 160 reads from the memory 170 a program suitable for a configuration in which the fusing unit 5 has the first halogen lamp 10, the second halogen lamp 20 and the third halogen lamp 30, and in which the switch system has the relays 122 and 124, and the triacs 126 and 128, and controls the switch control unit 150 based on the program.

For example, when forming an image on a medium with a small width, such a as B5 paper, the integrated control unit 160 controls the switch control unit 150 to turn the relay 122 and the traic 126 on, and as a result, only the first halogen lamp 10 is supplied with power and heats the medium. When forming an image on a medium with a large width, such as A4 paper, the integrated control unit 160 controls the switch control unit 150 to turn the relay 124 and the triac 126 on, and as a result, only the second halogen lamp 20 is supplied with power and heats the heating roller 5A, heating the medium. In these cases, the switch control unit 150 may first turn the relay 122 or 124 on and then turn the triac 126 on.

The integrated control unit 160 controls the switch control unit 150 so that the triac 126 is turned on or off to maintain the heating roller 5A at a predetermined temperature. The image-forming apparatus has a temperature detection unit, such as a thermistor, near the fusing unit 5, and the integrated control unit 160 controls the switch control unit 150 based on the temperature detected by the temperature detection unit.

Furthermore, when suppressing any inrush current that flows into the first halogen lamp 10 and the second halogen lamp 20, the integrated control unit 160 controls the switch control unit 150 to turn the triac 128 on before turning the relays 122 and 124, and the triac 126 on. As a result, the third halogen lamp 30 is connected in series to the first halogen lamp 10 and the second halogen lamp 20, making it possible to reduce the inrush current that flows into the fusing unit 5 when the relays 122 and 124, and the triac 126 are turned on, and consequently, to reduce flicker caused by the inrush current that flows through the image-forming apparatus.

After the heating roller 5A is preheated by the first halogen lamp 10, the second halogen lamp 20 and the third halogen lamp 30, the integrated control unit 160 controls the switch control unit 150 to turn the triac 128 off, and the triac 126 on. Consequently, the heating roller 5A is heated by the first halogen lamp 10 and/or the second halogen lamp 20.

When the first halogen lamp 10 and/or the second halogen lamp 20 are turned off and then turned on again to maintain the heating roller 5A at a predetermined temperature, the integrated control unit 160 may turn the triac 126 on to turn the first halogen lamp 10 and/or the second halogen lamp 20 on, or may also first turn the triac 128 on, and then turn the triac 128 off, and then turn the triac 126 on to turn the first halogen lamp 10 and/or the second halogen lamp 20 on.

When information relating to the shipping destination for the image-forming apparatus or the fusing unit 5 is stored in the memory 50, the integrated control unit 160 may control whether or not the third halogen lamp 30 is supplied with power based on that information. For example, if the shipping destination stored in the memory 50 is a country or area not requiring compliance with flicker standards (e.g., Japan), the integrated control unit 160 does not use the third halogen lamp 30, and if it is a country or area requiring compliance with flicker standards (e.g., Europe), it uses the third halogen lamp 30.

Figure 7:
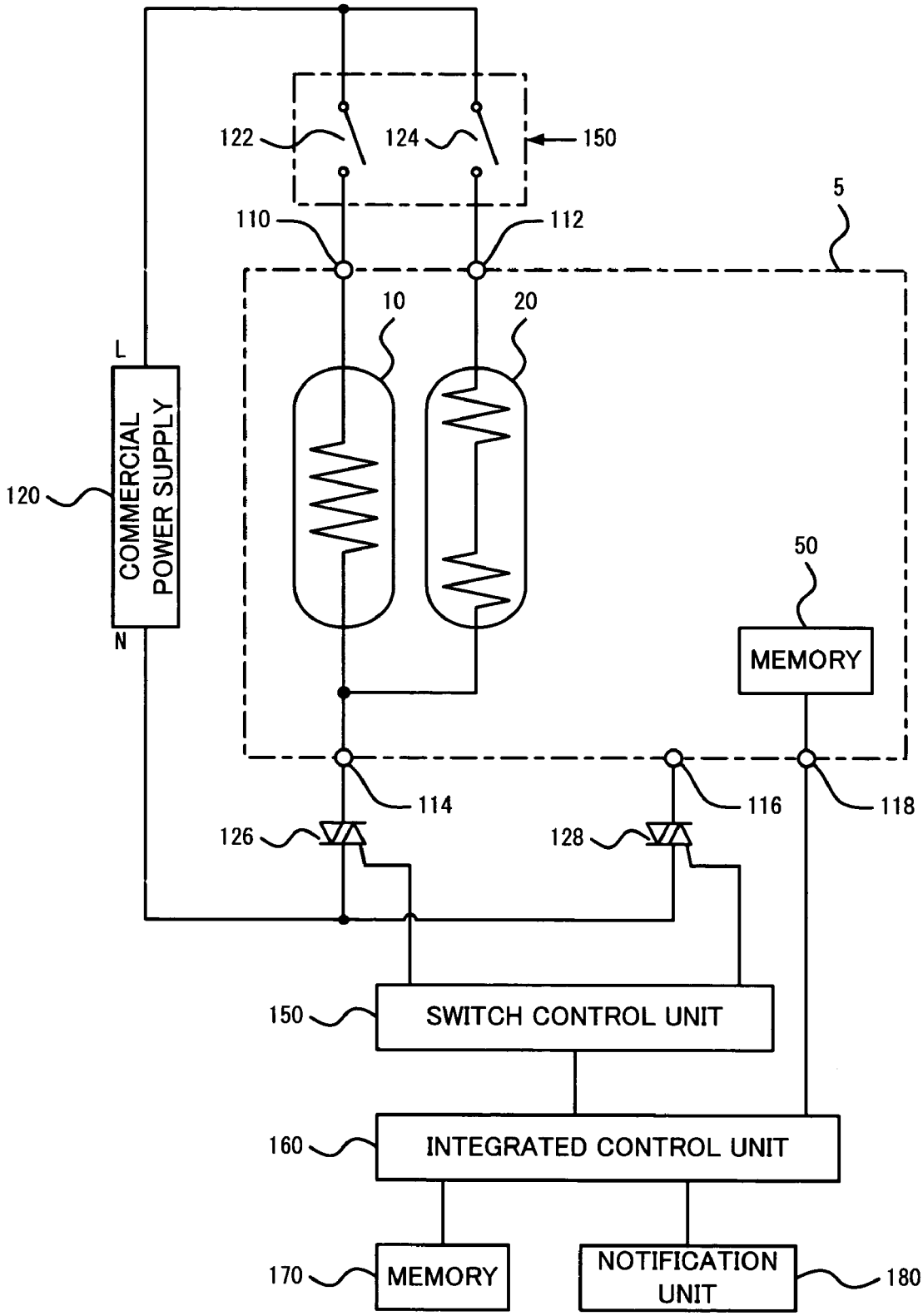
FIG. 7 is a diagram showing the configurations of a fusing unit and a power supply system according to the fifth embodiment of the invention.

FIG. 7 is a diagram showing the configurations of a fusing unit 5 and a power supply system according to the fifth embodiment of the invention. FIG. 7 shows an example of the image-forming apparatus having the power supply system according to the fourth embodiment, with a fusing unit 5 having a configuration different from that of the fusing unit 5 according to the fourth embodiment mounted therein. The configuration of the fusing unit 5 and the operation of the image-forming apparatus according to the fifth embodiment will be explained below focussing on the differences between it and the above embodiments. The configurations provided with the same reference numerals as those in the above embodiments have the same configurations and functions as those in these embodiments.

In this embodiment, the fusing unit 5 has the first halogen lamp 10, the second halogen lamp 20, and the memory 50. In other words, compared to the fusing unit 5 according to the fourth embodiment (see FIG. 6), the fusing unit 5 according to the fifth embodiment has the third halogen lamp 30. The fusing unit 5 according to the fifth embodiment is one that is to be shipped to a country or area not requiring compliance with flicker standards (e.g., Japan).

In this embodiment, the memory 50 stores unit identification information indicating that the fusing unit 5 only has the first halogen lamp 10 and the second halogen lamp 20. Upon the fusing unit 5 being mounted in the image-forming apparatus, the integrated control unit 160 reads the unit identification information from the memory 50.

This embodiment has a combination in which the halogen lamps of the fusing unit 5 are properly connected to the terminals 110 to 114, and in which nothing is connected to the terminal 116. Since that combination is one where the power supply system can control the first halogen lamp 10 and the second halogen lamp 20 in the fusing unit 5, it is contained in the combination information stored in the memory 170. Accordingly, the integrated control unit 160 determines that the combination of the fusing unit 5 and the switch system is compatible.

The integrated control unit 160 reads from the memory 170 a program suitable for a configuration in which the fusing unit 5 has the first halogen lamp 10 and the second halogen lamp 20, and in which the switch system has the relays 122 and 124, and the triacs 126 and 128, and controls the switch control unit 150 based on the program. More specifically, the integrated control unit 160 controls the switch control unit 150 to arbitrarily turn the relays 122 and 124, and the triac 126 on or off according to the size of the medium, etc.

The memory 170 may store combination information rendering the combination according this embodiment incompatible. In other words, the memory 170 may store configuration information that does not include the combination according to this embodiment. In this case, the integrated control unit 160 determines that the combination of the fusing unit 5 and the switch system is not compatible, and notifies the user to that effect via a notification unit 180. The notification unit 180 may be a display such as a liquid-crystal panel, or a sound generator such as a speaker.

Figure 8:
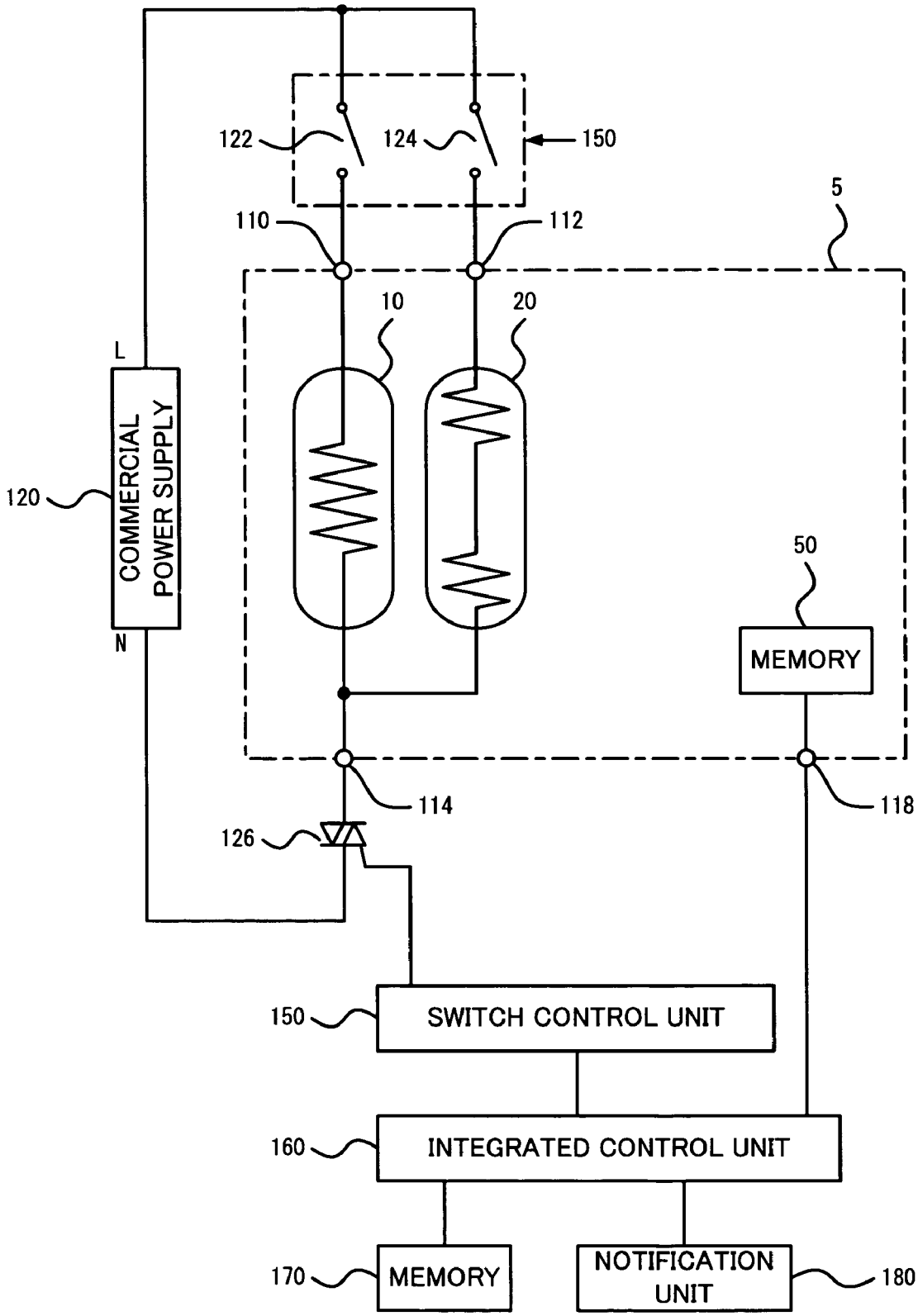
FIG. 8 is a diagram showing the configurations of a fusing unit and a power supply system according to the sixth embodiment of the invention.

FIG. 8 is a diagram showing the configurations of a fusing unit 5 and a power supply system according to the sixth embodiment of the invention. The configuration and operation of the fusing unit 5 and the image-forming apparatus according to the sixth embodiment will be explained below focussing on the differences from the above embodiments. The configurations provided with the same reference numerals as those in the above embodiments have the same configurations and functions as those in these embodiments.

In this embodiment, the power supply system has the terminals 110 to 114, and 118, the commercial power supply 120, the relays 122 and 124, the triac 126, and the switch control unit 150. In other words, compared to the power supply systems (see FIG. 6 or FIG. 7) according to the fourth and fifth embodiments, the power supply system according to the sixth embodiment does not have the triac 128.

In this embodiment, the memory 170 stores switch identification information indicating that the power supply system only has the relays 122 and 124, and the triac 126. The memory 50 stores unit identification information indicating that the fusing unit 5 has the first halogen lamp 10 and the second halogen lamp 20.

This embodiment has a combination in which the halogen lamps of the fusing unit 5 are properly connected to the terminals 110 to 114, and that combination is contained in the combination information stored in the memory 170. Accordingly, the integrated control unit 160 determines that the combination of the fusing unit 5 and the switch system is compatible.

The integrated control unit 160 reads from the memory 170 a program suitable for a configuration in which the fusing unit 5 has the first halogen lamp 10 and the second halogen lamp 20, and in which the switch system has the relays 122 and 124, and the triac 126, and controls the switch control unit 150 based on the program.

Figure 9:
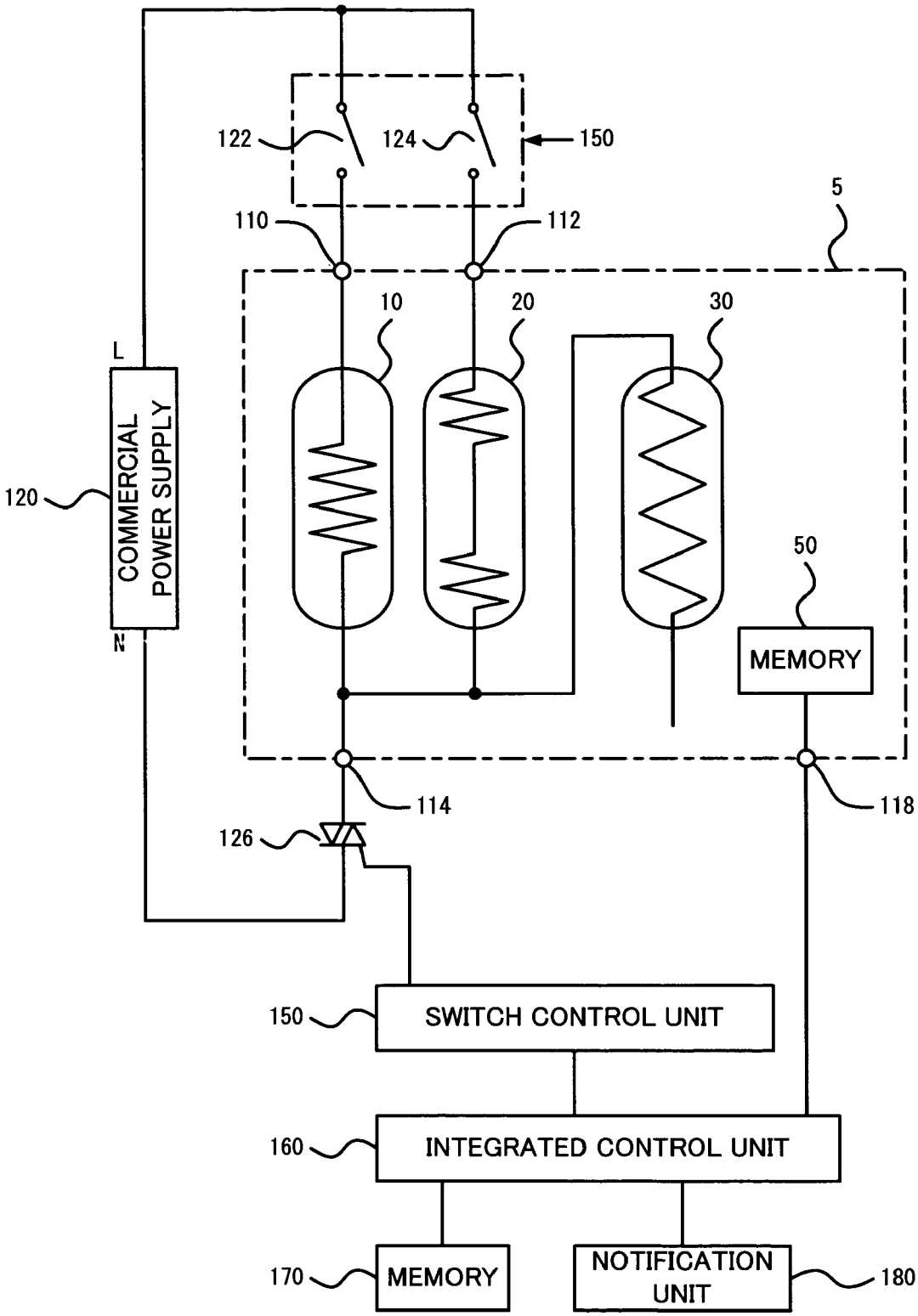
FIG. 9 is a diagram showing the configurations of a fusing unit and a power supply system according to the seventh embodiment of the invention.

FIG. 9 is a diagram showing the configuration of a fusing unit 5 and a power supply system according to the seventh embodiment of the invention. The configuration and operation of the fusing unit 5 and the image-forming apparatus according to the seventh embodiment will be explained below focussing on the differences between it and the above embodiments. The configurations provided with the same reference numerals as those in the above embodiments have the same configurations and functions as those in these embodiments.

In the seventh embodiment, the power supply system has the terminals 110 to 114, and 118, the commercial power supply 120, the relays 122 and 124, the triac 126, and the switch control unit 150. The fusing unit 5 has the first halogen lamp 10, the second halogen lamp 20, the third halogen lamp 30, and the memory 50.

The memory 170 stores information indicating that the power supply system only has the relays 122 and 124, and the triac 126, and the memory 50 stores unit identification information indicating that the fusing unit 5 has the first halogen lamp 10, the second halogen lamp 20 and the third halogen lamp 30.

This embodiment has a combination in which the halogen lamps in the fusing unit 5 are not properly connected to the terminals 110 to 116. More specifically, one end of the third halogen lamp 30 is not connected to any of the terminals of the power supply system, and therefore, that combination does not match any combination in the combination information stored in the memory 170. Accordingly, the integrated control unit 160 determines that the combination of the fusing unit 5 and the switch system is incompatible, and notifies the user to that effect via the notification unit 180.

In the seventh embodiment, the integrated control unit 160 may indicate via the notification unit 180 that the third halogen lamp 30 cannot be used. Also, In this embodiment, the integrated control unit 160 may read from the memory 170 a program suitable for a configuration in which the fusing unit 5 has the first halogen lamp 10 and the second halogen lamp 20, and in which the switch system has the relays 122 and 124, and the triac 126, and control the switch control unit 150 based on the program.

Figure 10:
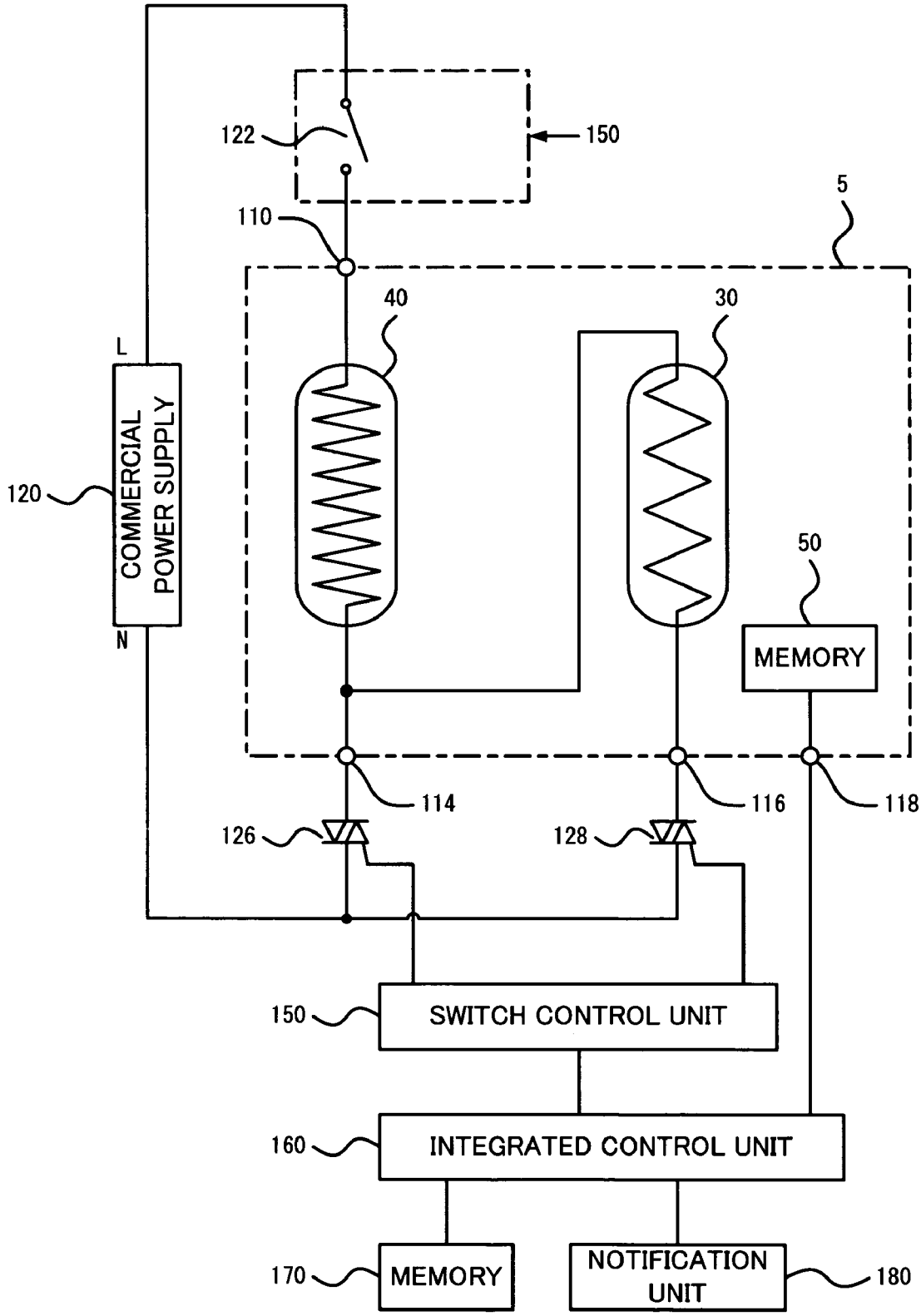
FIG. 10 is a diagram showing the configurations of a fusing unit and a power supply system according to the eighth embodiment of the invention.

FIG. 10 is a diagram showing the configuration of a fusing unit 5 and a power supply system according to the eighth embodiment of the invention. The configuration and operation of the fusing unit 5 and the image-forming apparatus according to the eighth embodiment will be explained below focussing on the differences between it and the above embodiments.

In this embodiment, the power supply system has the terminals 110, 114 and 116, the commercial power supply 120, the relay 122, the triacs 126 and 128, and the switch control unit 150. The fusing unit 5 has the third halogen lamp 30, the fourth halogen lamp 40, and the memory 50. The fourth halogen lamp 40 can heat an area that is substantially the same in size as the area of the heating roller 5A that is heated by the first halogen lamp 10 and the second halogen lamp 20. The fourth halogen lamp 40 is provided at the same position as the first halogen lamp 10 in the fusing unit 5. The fusing unit 5 of this embodiment is one that is to be shipped to a country or area requiring compliance with flicker standards where users do not use 22 mediums with different sizes very much (e.g., Europe).

The memory 170 stores switch identification information indicating that the power supply apparatus only has the relay 122, and the triacs 126 and 128, and the memory 50 stores unit identification information indicating that the fusing unit 5 only has the third halogen lamp 30 and the fourth halogen lamp 40.

This embodiment has a combination in which the halogen lamps of the fusing unit 5 are properly connected to the terminals 110, 114, and 116, and that combination is stored in the combination information stored in the memory 170. Accordingly, the integrated control unit 160 determines that the combination of the fusing unit 5 and the switch system is compatible.

The integrated control unit 160 reads from the memory 170 a program suitable for a configuration in which the fusing unit 5 has the third halogen lamp 30 and the fourth halogen lamp 40, and in which the switch system has the relay 122, and the triacs 126 and 128, and controls the switch control unit 150 based on the program.

Figure 11:
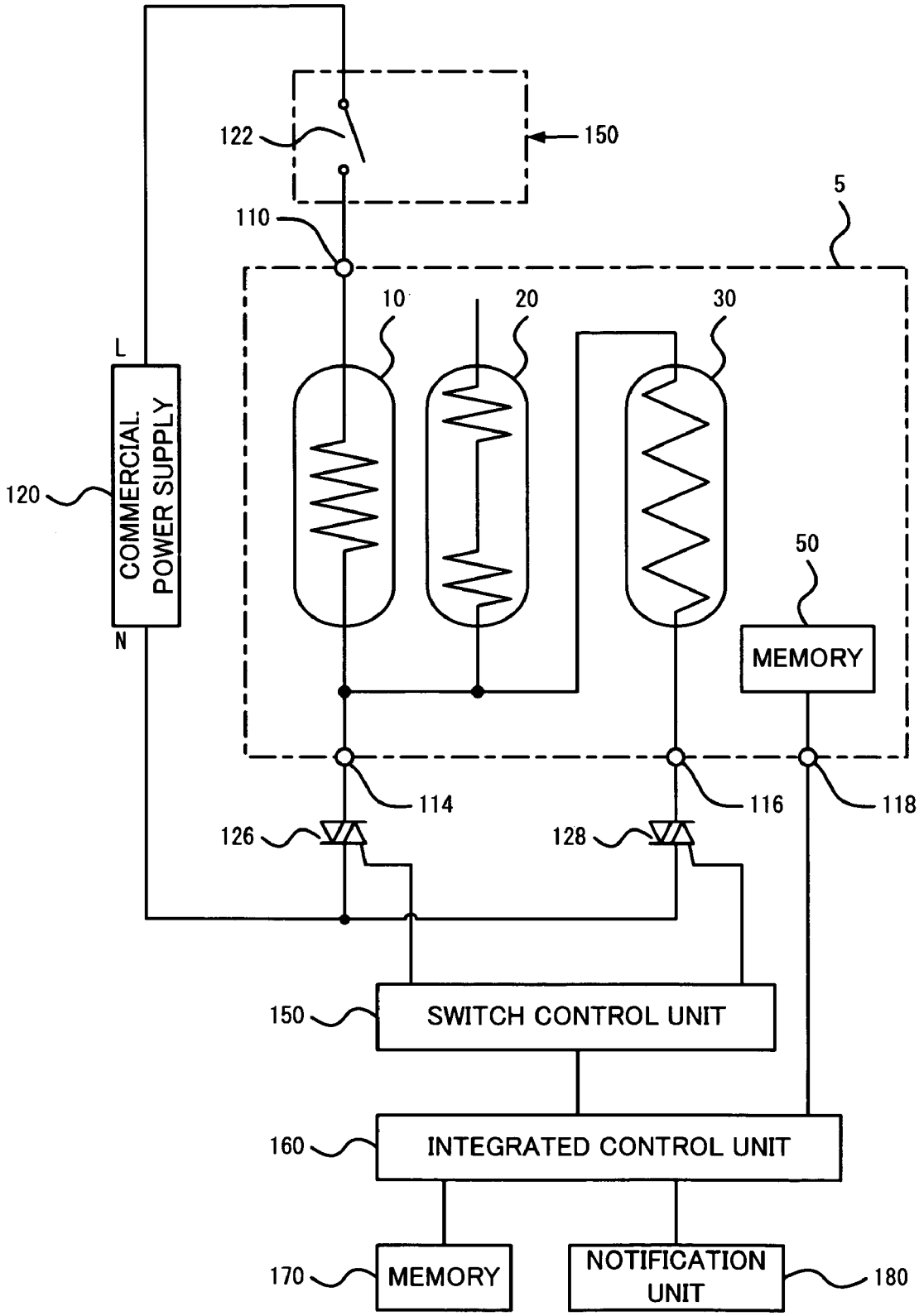
FIG. 11 is a diagram showing the configurations of a fusing unit and a power supply system according to the ninth embodiment of the invention.

FIG. 11 is a diagram showing the configuration of a fusing unit 5 and a power supply system according to the ninth embodiment of the invention. The configuration and operation of the fusing unit 5 and the image-forming apparatus according to the ninth embodiment will be explained below focussing on the differences between it and the above embodiments.

In the ninth embodiment, the power supply system has the terminals 110, 114 and 116, the commercial power supply 120, the relay 122, the triacs 126 and 128, and the switch control unit 150. The fusing unit 5 has the first halogen lamp 10, the second halogen lamp 20, and the third halogen lamp 30, and the memory 50.

The memory 170 stores switch identification information indicating that the power supply system only has the relay 122, and the triacs 126 and 128, and the memory 50 stores unit identification information indicating that the fusing unit 5 has the first halogen lamp 10, the second halogen lamp 20, and the third halogen lamp 30.

This embodiment has a combination in which the halogen lamps of the fusing unit 5 are not properly connected to the terminals 110, 114, and 116. More specifically, one end of the second halogen lamp 20 is not connected to any of the terminals included in the power supply system, and therefore, that combination does not match any combination in the combination information stored in the memory 170. Accordingly, the integrated control unit 160 determines that the combination of the fusing unit 5 and the switch system is incompatible, and notifies the user to that effect via the notification unit 180.

In this embodiment, the integrated control unit 160 may indicate via the notification lamp 180 that the second halogen lamp 20 cannot be used. In this embodiment, the integrated control unit 160 may read from the memory 170 a program suitable for a configuration in which the fusing unit 5 has the first halogen lamp 10 and the third halogen lamp 30, and in which the switch system has the relay 122, and the triacs 126 and 128, and controls the switch control unit 150 based on that program. In this case, since it is impossible to properly form an image on a medium with a width larger than the area of the heating roller 5A heated by the first halogen lamp 10, the integrated control unit 160 may notify the user to that effect via the notification unit 180.

Figure 12:
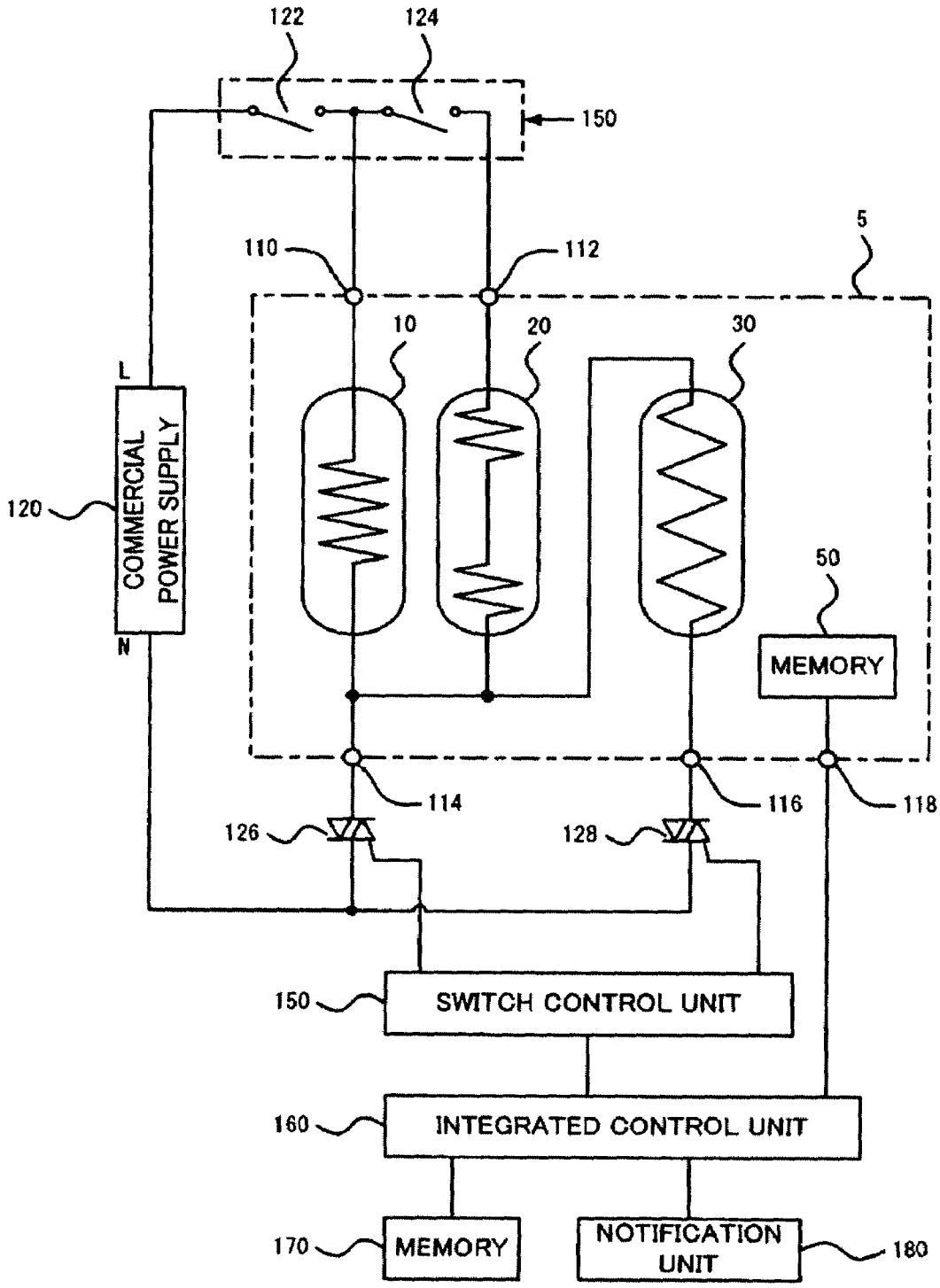
FIG. 12 is a diagram showing another example of a power supply system that supplies power to a fusing unit according to an embodiment of the present invention.

FIG. 12 is a diagram showing another example of a power supply system that supplies the fusing unit 5 with power. As shown in FIG. 12, the relays 122 and 124 may be connected in series. In other words, the relay 124 is provided between the relay 122 and the terminal 112, and the terminal 112 is connected to the commercial power supply 120 via the relays 122 and 124. The integrated control unit 160, as in the above embodiments, controls the switch control unit 150 to turn the relays 122 and 124 on or off to heat the heating roller 5A.

According to the above-described embodiments, the power supply to the fusing unit 5 may be controlled according to the switch system type, and the type of fusing unit 5 mounted. Accordingly, the above embodiments make it possible to provide a highly-versatile image-forming apparatus compatible with many types of the fusing units 5 and switch systems.

Also, according to the above embodiments, a suitable program can be selected based on the combination of the fusing unit 5 and the switch system to properly control the operation of the switch system, making it possible to provide a more highly-versatile image-forming apparatus. According to the embodiments, when the combination of the fusing unit 5 and the switch system is incompatible, it is possible to notify the user to that effect.

Each of the examples and applications of the invention described through the aforementioned embodiments may arbitrarily be used in any combination, or modified or altered according to use. The invention is not limited to the above-described embodiments. It is clear from the claim recitations that any such combination, modification or alternation is included in the technical scope of the invention.

What is claimed is:

1. An image-forming apparatus for forming an image by heating a medium, the image-forming apparatus comprising:

a connector connectable to a heating unit that heats the medium;

a commercial power supply that generates power to be supplied to the heating unit;

a switch system, provided between the heating unit and the commercial power supply, that switches the supply of the power to the heating unit on or off; and a switch control unit that controls the switch system based on the heating unit type.

2. The image-forming apparatus according to claim 1, wherein the image-forming apparatus forms an image by fixing toner to the medium; and wherein the heating unit is a fusing unit that fixes toner to the medium by heating the medium.

3. The image-forming apparatus according to claim 1, wherein the heating unit has a memory unit that stores identification information for identifying the heating unit type; and wherein the switch control unit controls the switch system based on the identification information read from the heating unit connected to the connector.

4. The image-forming apparatus according to claim 1, wherein the commercial power supply has a first terminal and a second terminal that supply the power; and wherein the switch system includes:

a first relay provided between the first terminal and the heating unit; and a first triac provided between the second terminal and the heating unit.

5. The image-forming apparatus according to claim 4, wherein the switch system includes:

second relay provided between the first terminal and the heating unit, in parallel with the first relay; and a second triac provided between the second terminal and the heating unit, in parallel with the first triac.

6. The image-forming apparatus according to claim 1, wherein the switch control unit that controls the switch system based on the heating unit type and the switch system type.

7. The image-forming apparatus according to claim 6, wherein the image-forming apparatus forms an image by fixing toner to the medium; and wherein the heating unit is a fusing unit that fixes toner to the medium by heating the medium.

8. The image-forming apparatus according to claim 6, wherein the image-forming apparatus further comprises a first memory unit that stores switch identification information for identifying the switch system type;

wherein the heating unit has a second memory unit that stores unit identification information for identifying the heating unit type; and wherein the switch control unit controls the switch system based on the switch identification information and the unit identification information read from the first memory unit and the second memory unit.

9. The image-forming apparatus according to claim 8, wherein the first memory unit further stores a plurality of programs for controlling the operation of the image-forming apparatus; and wherein the switch control unit controls the switch system based on a program, from among the plurality of programs, read from the first memory unit based on the switch identification information and the unit identification information.

10. The image-forming apparatus according to claim 8:

wherein the first memory unit further stores a plurality of combinations of switch identification information and unit identification information; and a notification unit that gives a notification based on the result of comparing the switch identification information and the unit identification information read from the first memory unit and the second memory unit, and the plurality of combinations stored in the first memory unit.

11. The image-forming apparatus according to claim 6, wherein the commercial power supply has a first terminal and a second terminal to supply the power;

wherein the switch system includes:

a first relay provided between the first terminal and the heating unit; and a first triac provided between the second terminal and the heating unit.

12. The image-forming apparatus according to claim 11, wherein the switch relay system further includes:

a second relay provided between the first terminal and the heating unit, in parallel with the first relay; and a second triac provided between the second terminal and the heating unit, in parallel with the first triac.

* * * * *